US010803784B2

(12) United States Patent
Kim et al.

(10) Patent No.: US 10,803,784 B2
(45) Date of Patent: Oct. 13, 2020

(54) DISPLAY DEVICE AND DRIVING METHOD OF THE SAME

(71) Applicant: Samsung Display Co., Ltd., Yongin-Si, Gyeonggi-Do (KR)

(72) Inventors: Jinpil Kim, Suwon-si (KR); Gyusu Lee, Asan-si (KR); Moonshik Kang, Hwaseong-si (KR); Jaesung Bae, Suwon-si (KR); Jaehoon Lee, Seoul (KR); Kyoungho Lim, Suwon-si (KR); Namjae Lim, Gwacheon-si (KR); Seokha Hong, Seoul (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 2 days.

(21) Appl. No.: 16/184,283

(22) Filed: Nov. 8, 2018

(65) Prior Publication Data

US 2019/0147792 A1 May 16, 2019

(30) Foreign Application Priority Data

Nov. 13, 2017 (KR) ..... 10-2017-0150667

(51) Int. Cl.
*G09G 5/00* (2006.01)
*G09G 3/36* (2006.01)
(Continued)

(52) U.S. Cl.
CPC ..... *G09G 3/2096* (2013.01); *G09G 3/2003* (2013.01); *G09G 3/3225* (2013.01); *G09G 5/14* (2013.01); *G09G 3/3266* (2013.01); *G09G 3/3275* (2013.01); *G09G 2310/0232* (2013.01); *G09G 2310/0243* (2013.01); *G09G 2310/08* (2013.01); *G09G 2320/0242* (2013.01); *G09G 2320/0673* (2013.01); *G09G 2320/0686* (2013.01); *G09G 2340/06* (2013.01); *G09G 2360/06* (2013.01)

(58) Field of Classification Search
CPC ... G09G 5/00; G09G 3/30; G09G 3/36; G06F 3/038
See application file for complete search history.

(56) References Cited

U.S. PATENT DOCUMENTS 6,657,622 B2 * 12/2003 Park ..... G09G 3/20 345/205
9,135,848 B2 * 9/2015 Park ..... G09G 3/20
(Continued)

FOREIGN PATENT DOCUMENTS

KR 1020170035387 A 3/2017

*Primary Examiner* — Pegeman Karimi
(74) *Attorney, Agent, or Firm* — Cantor Colburn LLP

(57) ABSTRACT

A display device includes a display panel including a plurality of pixels, the display panel including a first display area and a second display area, a first image processor which receives a first image data to be provided to the first display area, convert the first image data to a first convert data, and generate a first compensation data provided to the first display area using a first average filter, and a second image processor which receives a second image data to be provided to the second display area, converts the second image data to a second convert data, and generates a second compensation data provided to the second display area using a second average filter.

20 Claims, 12 Drawing Sheets

(51) Int. Cl.

| | |
|---|---|
| ***G09G 3/20*** | (2006.01) |
| ***G09G 5/14*** | (2006.01) |
| ***G09G 3/3225*** | (2016.01) |
| *G09G 3/3266* | (2016.01) |
| *G09G 3/3275* | (2016.01) |

(56) References Cited

U.S. PATENT DOCUMENTS

| | | | | |
|---|---|---|---|---|
| 9,997,096 | B2 * | 6/2018 | Shin | G06F 3/1446 |
| 2009/0322661 | A1 * | 12/2009 | Bae | G09G 3/3648 345/87 |
| 2011/0279466 | A1 * | 11/2011 | Park | G09G 3/3648 345/581 |
| 2016/0171918 | A1 | 6/2016 | Kim et al. | |

* cited by examiner

<RGB COLOR SPACE>

<HSV COLOR SPACE>

DISPLAY DEVICE AND DRIVING METHOD OF THE SAME

This application claims priority to Korean Patent Application No. 10-2017-0150667, filed on Nov. 13, 2017 and all the benefits accruing therefrom under 35 U.S.C. § 119, the content of which in its entirety is herein incorporated by reference.

BACKGROUND

1. Field

Exemplary embodiments relate generally to a display device. More particularly, exemplary embodiments of the invention relate to a display device and a driving method of the same.

2. Description of the Related Art

A flat panel display ("FPD") device is widely used as a display device of electronic devices because the FPD device is relatively lightweight and thin compared to a cathode-ray tube ("CRT") display device. Examples of the FPD device include a liquid crystal display ("LCD") device, a field emission display ("FED") device, a plasma display panel ("PDP") device, and an organic light emitting display ("OLED") device. The OLED device has been spotlighted as next-generation display devices because the OLED device has various advantages such as a wide viewing angle, a rapid response speed, a thin thickness, low power consumption, etc.

Recently, a driving method of the OLED device that divides a display panel into at least two areas and couples a chip for driving each of the least two areas is studied as a size and a resolution of the OLED device increases.

SUMMARY

Some exemplary embodiments provide a display device capable of improving display quality.

Some exemplary embodiments provide a driving method of the display device capable of improving display quality.

According to an exemplary embodiment of exemplary embodiments, a display device may include a display panel including a plurality of pixels, the display panel including a first display area and a second display area, a first image processor which receives a first image data that will be provided to the first display area, converts the first image data to a first convert data, and generates a first compensation data provided to the first display area using a first average filter, a second image processor which receives a second image data that will be provided to the second display area, converts the second image data to a second convert data, and generates a second compensation data provided to the second display area using a second average filter. The first image processor receives the second convert data of pixels of the plurality of pixels in the second display area adjacent to the first display area from the second image processor, and calculate the first compensation data based on the first convert data and the second convert data. The second image processor receives the first convert data of pixels of the plurality of pixels in the first display area adjacent to the second display area from the first image processor, and calculate the second compensation data based on the second convert data and the first convert data.

In an exemplary embodiment, the first convert data and the second convert data may be HSV data.

In an exemplary embodiments, the first image processor may include a first converter which converts the first image data to the first convert data, a first receiver which receives the first convert data from the first converter, and receives the second convert data of the pixels in the second display area adjacent to the first display area from the second image processor, and a first compensator which generates the first compensation data based on the first convert data and the second convert data using the first average filter.

In an exemplary embodiment, the first image processor may further include a spatial dividing panel ("SDP") driver which detects a compensating area based on the first convert data, and performs an SDP driving method to the compensating area.

In an exemplary embodiment, the first receiver may receive the second convert data of n/2 pixels of the pixels in the second display area adjacent to the first display area when the first average filter generates the first compensation data by calculating an average value of the first convert data of n pixels of the pixels in the first display area.

In an exemplary embodiment, the first receiver may receive a representation value of the second convert data of the pixels in the second display area adjacent to the first display area.

In an exemplary embodiment, the first receiver may receive a sampling value of the second convert data of the pixels in the second display area adjacent to the first display area.

In an exemplary embodiment, the second image processor may include a second converter which converts the second image data to the second convert data, a second receiver which receives the second convert data from the second converter, and receives the first convert data of the pixels in the first display area adjacent to the second display area from the first image processor, and a second compensator which generates the second compensation data based on the first convert data and the second convert data using the second average filter.

In an exemplary embodiment, the second image processor may further include an SDP driver which detects a compensating area based on the second convert data, and performs an SDP driving method to the compensating area.

In an exemplary embodiment, the second receiver may receive the first convert data of n/2 pixels of the pixels in the first display area adjacent to the second display area when the second average filter generates the second compensation data by calculating an average value of the second convert data of the n pixels of the pixels in the second display area.

In an exemplary embodiment, the second receiver may receive a representation value of the first convert data of the pixels in the first display area adjacent to the second display area.

In an exemplary embodiment, the second receiver may receive a sampling value of the first convert data of the pixels in the first display area adjacent to the second display area.

In an exemplary embodiment, the first average filter may generate the first compensation data by sampling the first convert data and the second convert data, and the second average filter may generate the second compensation data by sampling the first convert data and the second convert data.

According to an exemplary embodiment, a driving method of a display device may include an operation of converting a first image data to a first convert data in a first image processor, an operation of converting a second image data to a second convert data in a second image processor, an operation of receiving a part of the second convert data in the first image processor, an operation of receiving a part of the first convert data in the second image processor, an operation of generating a first compensation data based on the first convert data and the part of the second convert data in the first image processor, and an operation of generating a second compensation data based on the second convert data and the part of the first convert data in the second image processor.

In exemplary embodiments, the driving method of the display device further include an operation of detecting a first compensating area of a first display area based on the first convert data and performing an SDP driving method to the first compensating area, and an operation detecting a second compensating area of a second display area based on the second convert data and performing the SDP driving method to the second compensating area.

In exemplary embodiments, the first convert data and the second convert data may be HSV data.

In exemplary embodiments, the first image processor may receive a representation value of the second convert data, and the second image processor may receive a representation value of the first convert data.

In exemplary embodiments, the first image processor may generate the first compensation data by sampling the first convert data and the part of the second convert data, and the second image processor may generate the second compensation data by sampling the second convert data and the part of the first convert data.

In exemplary embodiments, the first image processor may receive a sampling value of the part of the second convert data, and the second image processor may receive a sampling value of the part of the first convert data.

In exemplary embodiments, the first image processor may receive a representation value of the second convert data, and the second image processor may receive a representation value of the first convert data.

Therefore, the display device and the driving method of the display device prevent a user to recognize a boundary of the first display area and the second display area by dividing the display panel to the first display area and the second display area, including the first image processor coupled to the first display area and the second image processor coupled to the second display area, and exchanging the first convert data and the second convert data provided to the pixels disposed in the boundary of the first display area and the second display area. Further, the first image processor and the second processor may decrease a logic size desired to exchange the first convert data and the second convert data by providing and receiving the first convert data and the second convert data as represent value or sampling value.

BRIEF DESCRIPTION OF THE DRAWINGS

Illustrative, non-limiting exemplary embodiments will be more clearly understood from the following detailed description taken in conjunction with the accompanying drawings.

DETAILED DESCRIPTION

Figure 1:
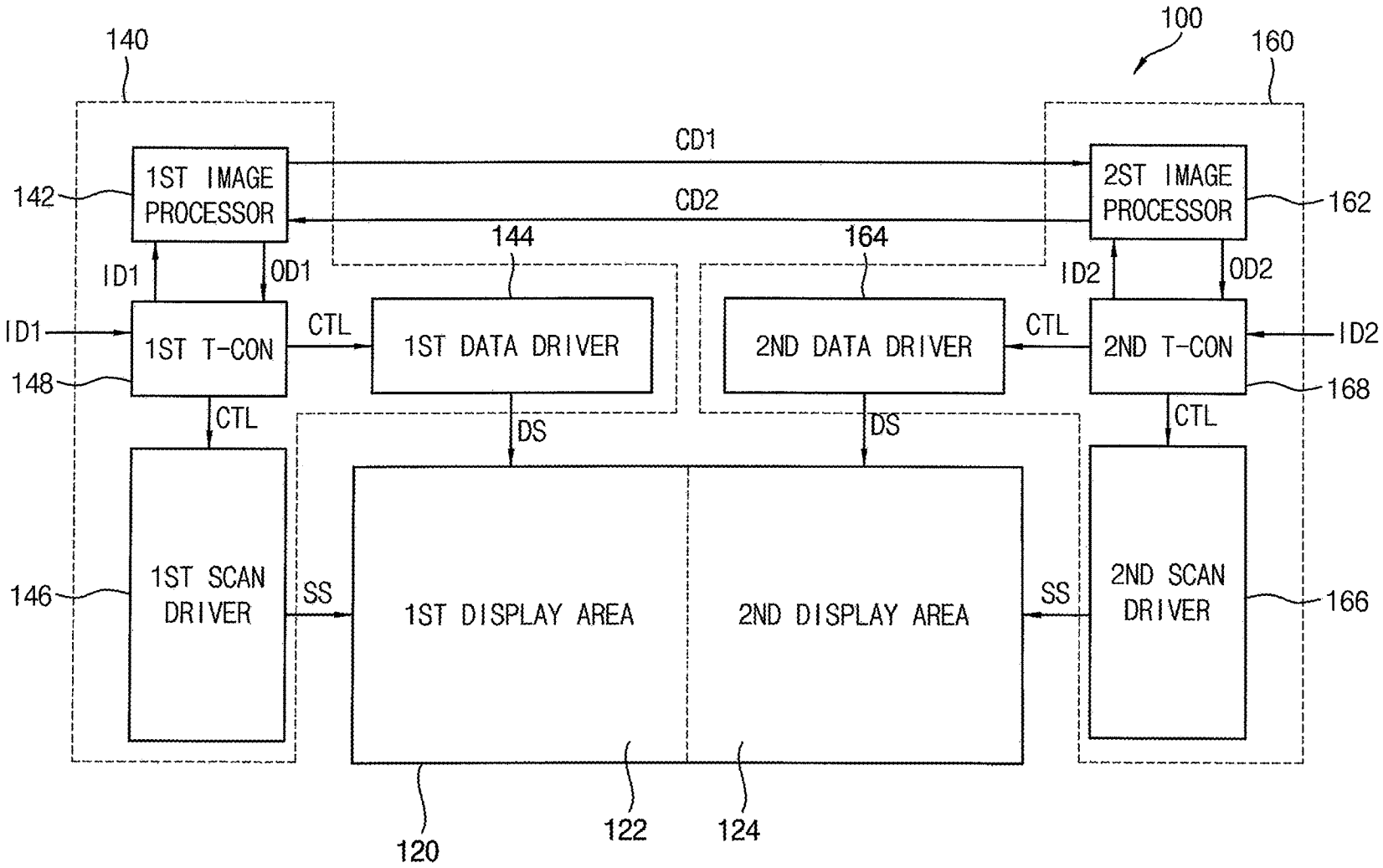
FIG. 1 is a block diagram illustrating an exemplary embodiment of a display device.

Hereinafter, the invention will be explained in detail with reference to the accompanying drawings. This invention may, however, be embodied in many different forms, and should not be construed as limited to the embodiments set forth herein. Rather, these embodiments are provided so that this invention will be thorough and complete, and will fully convey the scope of the invention to those skilled in the art. Like reference numerals refer to like elements throughout.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc., may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/ or "including" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. In an exemplary embodiment, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

Figure 2:
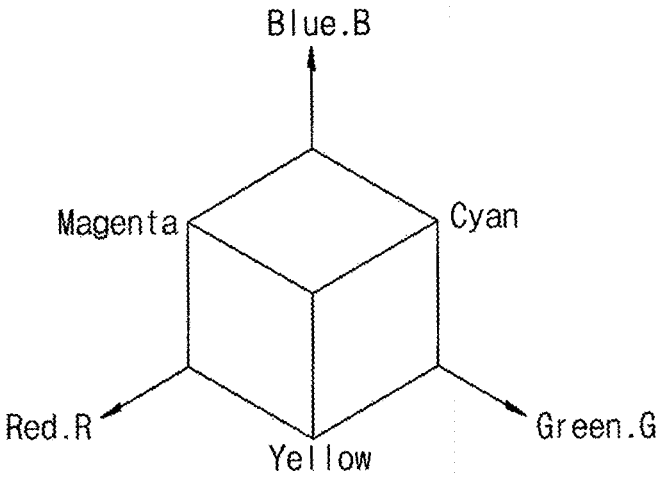
FIGS. 2 and 3 are diagrams illustrating an exemplary embodiment of a first image processor and a second image processor included in the display device of FIG. 1.
Figure 2:
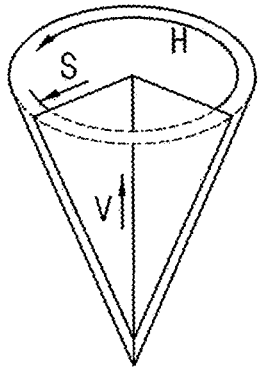
Figure 3:
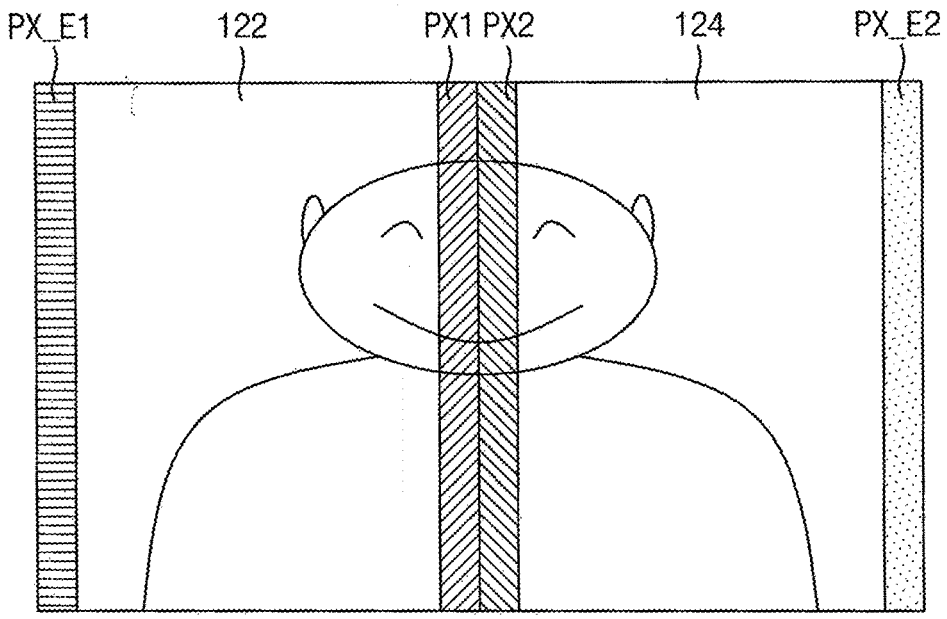

FIG. 1 is a block diagram illustrating a display device according to exemplary embodiments and FIGS. 2 and 3 are diagrams illustrating a first image processor and a second image processor included in the display device of FIG. 1.

Referring to FIG. 1, a display device 100 may include a display panel 120, a first driver 140, and a second driver 160.

The display panel 120 may include a plurality of pixels. A plurality of data lines and a plurality of scan lines may be formed in the display panel 120. The plurality of pixels may be formed in intersection regions of the data lines and the scan lines. In some exemplary embodiments, each of the pixels may include a pixel circuit, a driving transistor, and an organic light emitting diode ("OLED"). In this case, the pixel circuit may transfer a data signal DS provided through the data line in response to a scan signal SS provided through the scan line. The driving transistor may control a driving through the OLED based on the data signal DS. The OLED may emit light based on the driving current.

The display panel 120 may include a first display area 122 and a second display area 124. Display quality may improve by dividing the display panel 120 into a plurality of display areas, coupling driver to each of the display areas, and providing driving signals to each of the display areas when a size and a resolution of the display device 100 increases. However, a boundary of the first display area 122 and the second display area 124 may be detected by a user according to a compensation amount of display quality when a compensation of the display quality is preformed to each of the display areas. In order to overcome this problem, the display device 100 according to exemplary embodiments may receive the data signal DS respectively provided to the first display area 122 and the second display area 124 and compensate the first display area 122 and the second display area 124 using the data signals DS provided to the first display area 122 and the second display area 124. Hereinafter, the display device 100 according to exemplary embodiments will be described in detail.

The first display area 122 of the display panel 120 may be coupled to the first driver 140. The first driver 140 may include a first image processor 142, a first data driver 144, a first scan driver 146, and a first timing controller 148. The first driver 140 may be implemented as a chip and be coupled to the first display area 122 of the display panel 120.

The first image processor 142 may receive a first image data ID1 will be provided to the first display area 122, convert the first image data ID1 into a first convert data CD1, and generate a first compensation data OD1 provided to the first display area 122 using a first average filter.

The first image processor 142 may receive the first image data ID1 through a first timing controller 148. The first image data ID1 may be RGB data (that is, red data, green data, and blue data) provided to the pixels in the first display area 122. Referring to FIG. 2, the first image data ID1 may be data of a RGB color space composed by red color, green color, and blue color. The RGB color space may compose colors by a property of which white color is generated when the red color, the green color, and the blue color are mixed. The first image processor 142 may convert the first image data ID1 provided as a data of the RGB color space into the first convert data CD1. The first convert data CD1 may be a data of a HSV color space composed by a hue, a saturation, and a value. The HSV data may be represented by dividing a hue data H, a saturation data S, and a value V. The first image processor 142 may generate the first compensation data OD1 provided to the first display area 122 using the first average filter. The first average filter may calculate an average value of the first convert data CD1 provided to a reference pixel and the first convert data CD1 provided to peripheral pixels that include the reference pixel and generate the average value as the first compensation data OD1 of the reference pixel. In an alternative exemplary embodiment, the first average filter may perform sampling to the first convert data CD1 provided to the reference pixel and the first convert data CD1 provided to the peripheral pixels that include the reference pixel, calculate an average value of the first convert data CD1 to which the sampling is performed, and generate the average value as the first compensation data OD1 of the reference pixel.

The first data driver 144 may generate the data signal DS based on the first compensation data OD1 provided from the first image processor 142 and provide the data signal DS to the pixels in the first display area 122. Although the first image processor 142 that provides the first compensation data OD1 to the first data driver 144 through the timing controller 148 is described in FIG. 1, the first image processor 142 may directly provide the first compensation data OD1 to the first data driver 144. The first data driver 144 may generate the data signal DS corresponding to the first compensation data OD1 in response to a control signal CTL provided from the first timing controller 148 and output the data signal DS to the data lines in the first display area 122.

The first scan driver 146 may provide the scan signal SS to the pixels in the first display area 122. The first scan driver 146 may generate the scan signal SS in response to the control signal CTL provided from the first timing controller 148 and output the scan signal SS to the scan lines in the first display area 122.

The first timing controller 148 may receive the first image data ID1 from an external device. The first timing controller 148 may provide the first image data ID1 to the first image processor 142. Further, the first timing controller 148 may generate the control signals CTL that control the first data driver 144 and the first scan driver 146 and provide the control signals CTL to the first data driver 144 and the first scan driver 146.

The second display area 124 of the display panel 120 may be coupled to the second driver 160. The second driver 160 may include a second image processor 162, a second data driver 164, a second scan driver 166, and a second timing controller 168. The second driver 160 may be implemented as a chip and be coupled to the second display area 124 of the display panel.

The second image processor 162 may receive a second image data ID2 that will be provided to the second display area 124, convert the second image data ID2 into a second convert data CD2, and generate a second compensation data OD2 provided to the second display area 124 using a second average filter.

The second image processor 162 may receive the second image data ID2 through a second timing controller 168. The second image data ID2 may be RGB data (that is, red data, green data, and blue data) provided to the pixels in the second display area 124. The second image processor 162 may convert the second image data ID2 provided as a data of the RGB color space into the second convert data CD2. The second convert data CD2 may be a data of a color space composed by a hue, a saturation, and a value. The second image processor 162 may generate the second compensation data OD2 provided to the second display area 124 using the second average filter. The second average filter may calculate an average value of the second convert data CD2 provided to a reference pixel and the second convert data CD2 provided to peripheral pixels that include the reference pixel and generate the average value as the second compensation data OD2 of the reference pixel. In an alternative exemplary embodiment, the second average filter may perform sampling to the second convert data CD2 provided to the reference pixel and the second convert data CD2 provided to the peripheral pixels that include the reference pixel, calculate an average value of the second convert data CD2 to which the sampling is performed, and generate the average value as the second compensation data OD2 of the reference pixel.

The second data driver 164 may generate the data signal DS based on the second compensation data OD2 provided from the second image processor 162 and provide the data signal DS to the pixels in the second display area 124. Although the second image processor 162 that provides the second compensation data OD2 to the second data driver 164 through the timing controller 168 is described in FIG. 1, the second image processor 162 may directly provide the second compensation data OD2 to the second data driver 164. The second data driver 164 may generate the data signal DS corresponding to the second compensation data OD2 in response to a control signal CTL provided from the second timing controller 168 and output the data signal DS to the data lines in the second display area 124.

The second scan driver 166 may provide the scan signal SS to the pixels in the second display area 124. The second scan driver 166 may generate the scan signal SS in response to the control signal CTL provided from the second timing controller 168 and output the scan signal SS to the scan lines in the second display area 124.

The second timing controller 168 may receive the second image data ID2 from an external device. The second timing controller 168 may provide the second image data ID2 to the second image processor 162. Further, the second timing controller 168 may generate the control signals CTL that control the second data driver 164 and the second scan driver 166 and provide the control signals CTL to the second data driver 164 and the second scan driver 166.

Referring to FIG. 3, the first image processor 142 may receive the second convert data CD2 of the pixels PX2 in the second display area 124 adjacent to the first display area 122. In some exemplary embodiments, the first image processor 142 may receive the second convert data CD2 of n/2 pixels in the second display area 124 adjacent to the first display area 122 when the first average filter of the first image processor 142 generates the average value of the first convert data CD1 of n pixels in the first display area 122 as the first compensation data OD1, where n is an integer equal to or greater than 2. In other exemplary embodiments, the first image processor 142 may receive a representation value of the second convert data CD2 of n/2 pixels in the second display area 124 adjacent to the first display area 122 when the first average filter of the first image processor 142 generates the average value of the first convert data CD1 of n pixels in the first display area 122 as the first compensation data OD1. In other exemplary embodiments, the first image processor 142 may receive a sampling value of the second convert data CD2 of n/2 pixels in the second display area 124 adjacent to the first display area 122 when the first average filter of the first image processor 142 generates the average value of the first convert data CD1 of n pixels in the first display area 122 as the first compensation data OD1.

The first image processor 142 may copy the first convert data CD1 of the pixel arranged in an outermost of the first display area 122 and generate the average value of the first convert data CD1 as the first compensation data OD1 in order to calculate the first compensation data OD1 of the pixels PX_E1 arranged in an edge of the first display area 122. In an exemplary embodiment, in order to calculate the first compensation data OD1 of the pixel arranged in the outermost of the first display area 122, the first image processor 142 may receive the first convert data CD1 of the pixel in the outermost of the first display area 122 four times and receive the first convert data CD1 of 4 pixels adjacent to the pixel in the outermost of the first display area 122 when the first average filter generates the average value of the first convert data CD1 of 8 pixels as the first compensation data OD1, for example. The first image processor 142 may generate the average value of the 8 first convert data CD1 as the first compensation data OD1.

The first image processor 142 may receive the second convert data CD2 of the pixels PX2 of the second display area 124 adjacent to the first display area 122 and calculate the first compensation data OD1 based on the first convert data CD1 and the second convert data CD2. The first image processor 142 may generate the average value of the first convert data CD1 and the second convert data CD2 as the first compensation data OD1 using the first average filter. In an exemplary embodiment, the first image processor 142 may generate the first compensation data OD1 of the reference pixel arranged in an outermost of the first display area 122 adjacent to the second display area 124 based on the first convert data CD1 of the reference pixel in the first display area 122, the first convert data CD1 of the (n/2−1) pixels adjacent to the reference pixel in the first display area 122, and the second convert data CD2 of the (n/2) pixels adjacent to the reference pixel in the second display area 124 when the first image processor 142 generates the average value of the convert data of n pixels as the first compensation data OD1, for example. That is, the first image processor 142 may generate the average value of the first convert data CD1 of the reference pixel in the first display area 122, the first convert data CD1 of the (n/2−1) pixels adjacent to the reference pixel in the first display area 122, and the second convert data CD2 of the n/2 pixels adjacent to the reference pixel in the second display area 124 as the first compensation data OD1 of the reference pixel.

Referring to FIG. 3, the second image processor 162 may receive the first convert data CD1 of the pixels PX1 in the first display area 122 adjacent to the second display area 124. In some exemplary embodiments, the second image processor 162 may receive the first convert data CD1 of n/2 pixels in the first display area 122 adjacent to the second display area 124 when the second average filter of the second image processor 162 generates the average value of the second convert data CD2 of n pixels in the second display area 124 as the second compensation data OD2. In other exemplary embodiments, the second image processor 162 may receive a representation value of the first convert data CD1 of n/2 pixels in the first display area 122 adjacent to the second display area 124 when the second average filter of the second image processor 162 generates the average value of the second convert data CD2 of n pixels in the second display area 124 as the second compensation data OD2. In other exemplary embodiments, the second image processor 162 may receive a sampling value of the first convert data CD1 of n/2 pixels in the first display area 122 adjacent to the second display area 124 when the second average filter of the second image processor 162 generates the average value of the second convert data CD2 of n pixels in the second display area 124 as the second compensation data OD2, for example.

The second image processor 162 may copy the second convert data CD2 of the pixel arranged in an outermost of the second display area 124 and generate the average value of the second convert data CD2 as the second compensation data OD2 in order to calculate the second compensation data OD2 of the pixels PX_E2 arranged in an edge of the second display area 124. In an exemplary embodiment, in order to calculate the second compensation data OD2 of the pixel arranged in the outermost of the second display area 124, the second image processor 162 may receive the second convert data CD2 of the pixel in the outermost of the second display area 124 four times and receive the second convert data CD2 of 4 pixels adjacent to the pixel in the outermost of the second display area 124 when the second average filter generates the average value of the second convert data CD2 of 8 pixels as the second compensation data OD2, for example. The second image processor 162 may generate the average value of the 8 second convert data CD2 as the second compensation data OD2.

The second image processor 162 may receive the first convert data CD1 of the pixels PX1 of the first display area 122 adjacent to the second display area 124 and calculate the second compensation data OD2 based on the second convert data CD2 and the first convert data CD1. The second image processor 162 may generate the average value of the second convert data CD2 and the first convert data CD1 as the second compensation data OD2 using the second average filter. In an exemplary embodiment, the second image processor 162 may generate the second compensation data OD2 of the reference pixel arranged in an outermost of the second display area 124 adjacent to the first display area 122 based on the second convert data CD2 of the reference pixel in the second display area 124, the second convert data CD2 of the (n/2−1) pixels adjacent to the reference pixel in the second display area 124, and the first convert data CD1 of the (n/2) pixels adjacent to the reference pixel in the first display area 122 when the second image processor 162 generates the average value of the convert data of n pixels as the second compensation data OD2, for example. That is, the second image processor 162 may generate the average value of the second convert data CD2 of the reference pixel in the second display area 124, the second convert data CD2 of the (n/2−1) pixels adjacent to the reference pixel in the second display area 124, and the first convert data CD1 of the n/2 pixels adjacent to the reference pixel in the first display area 122 as the second compensation data OD2 of the reference pixel.

Although the first image processor 142 coupled to the first timing controller 148 and the second image processor 162 coupled to the second timing controller 168 are described in FIG. 1, the first image processor 142 and the second image processor 162 are not limited thereto. In an exemplary embodiment, the first image processor 142 may be located in the first timing controller 148 and the second image processor 162 may be located in the second timing controller 168, for example.

As described above, the display device 100 of FIG. 1 may prevent the user to recognize the boundary of the first display area 122 and the second display area 124 by including the first image processor 142 and the second image processor 162. The first image processor 142 may generate the first compensation data OD1 based on the first convert data CD1 and the second convert data CD2 provided to the pixels in the boundary of the second display area 124. The second image processor 162 may generate the second compensation data OD2 based on the second convert data CD2 and the first convert data CD1 provided to the pixels in the boundary of the first display area 122.

Figure 4:
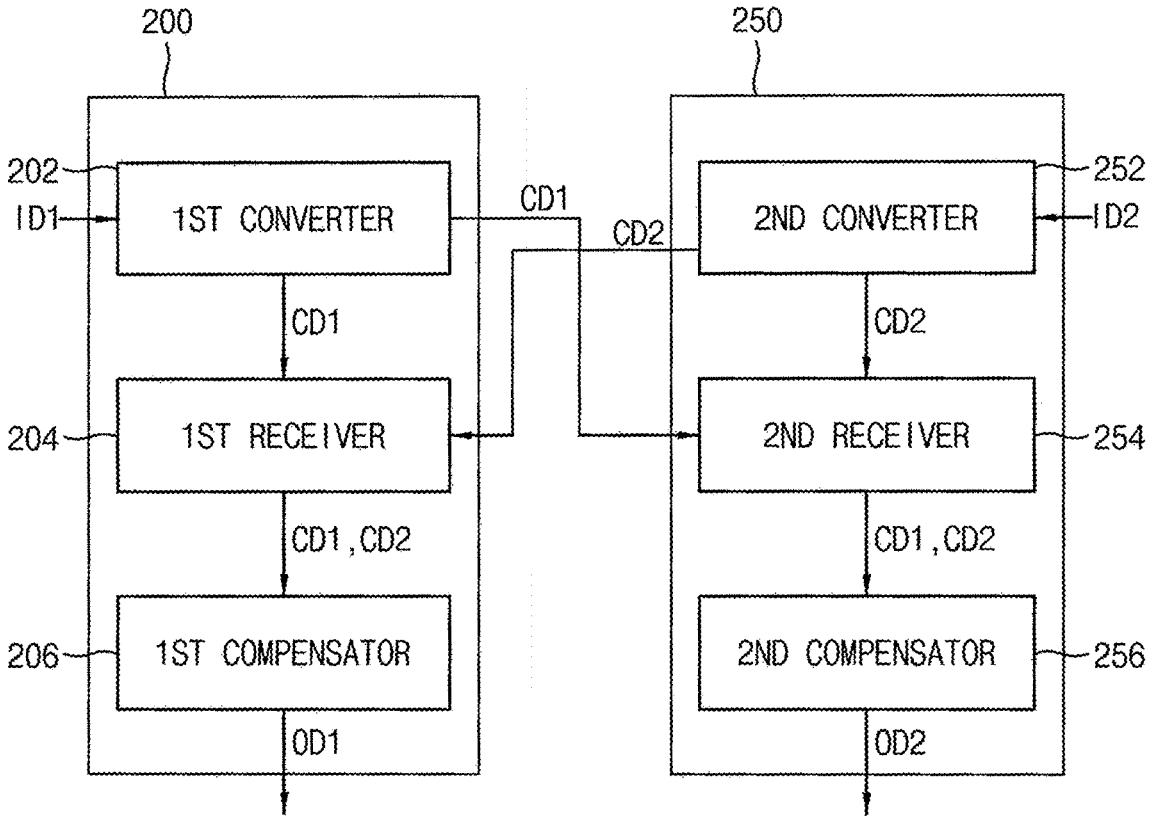
FIG. 4 is a block diagram illustrating an exemplary embodiment of a first image processor and a second image processor included in the display device of FIG. 1.
Figure 5A:
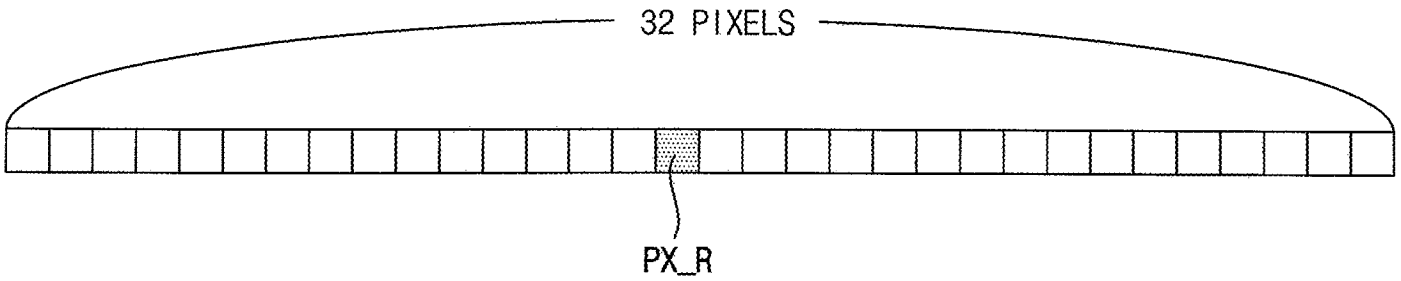
FIGS. 5A and 5B are diagrams illustrating an exemplary embodiment of an operation of a first compensator included in the first image processor of FIG. 3 and a second compensator included in the second image processor of FIG. 4.
Figure 5B:
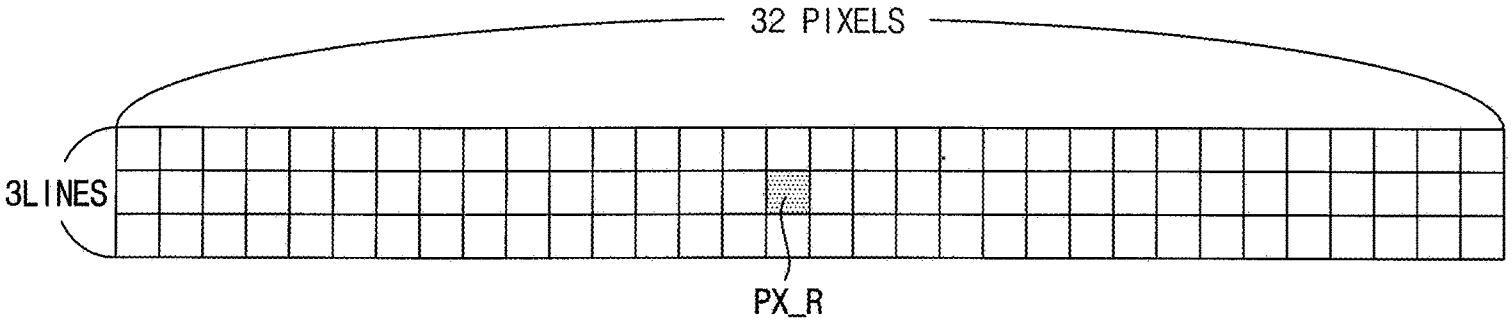

FIG. 4 is a block diagram illustrating an example of a first image processor and a second image processor included in the display device of FIG. 1 and FIGS. 5A and 5B are diagrams illustrating for describing an operation of a first compensator included in the first image processor of FIG. 3 and a second compensator included in the second image processor of FIG. 4.

Referring to FIG. 4, the first image processor 200 may include a first converter 202, a first receiver 204, and a first compensator 206.

The first converter 202 may convert a first image data ID1 into a first convert data CD1. Here, the first image data ID1 may be a RGB data and the first convert data CD1 may be a HSV data. The first converter 202 may provide the first convert data CD1 to the first receiver 204. Further, the first converter 202 may provide the first convert data CD1 of pixels in the first display area adjacent to the second display area to a second receiver 254 of a second image processor 250.

The first receiver 204 may receive the first convert data CD1 from the first converter 202 and a second convert data CD2 of pixels in the second display area adjacent to the first display area from a second converter 252. In some exemplary embodiments, the first receiver 204 may receive the second convert data CD2 of n/2 pixels in the second display area adjacent to the first display area when the first average filter of the first compensator 206 generates the average value of the first convert data CD1 of n pixels in the first display area as the first compensation data OD1. In other exemplary embodiments, the first image receiver 204 may receive a representation value of the second convert data CD2 of n/2 pixels in the second display area adjacent to the first display area when the first average filter of the first compensator 206 generates the average value of the first convert data CD1 of n pixels in the first display area as the first compensation data OD1. In other exemplary embodiments, the first receiver 204 may receive a sampling value of the second convert data CD2 of n/2 pixels in the second display area adjacent to the first display area when the first average filter of the first compensator 206 generates the average value of the first convert data CD1 of n pixels in the first display area as the first compensation data OD1.

The first receiver 204 may receive the second convert data CD2 to which the sampling is performed and interpolate the second convert data CD2 in order to decrease an exchanging amount of data between the first image processor 200 and the second image processor 250.

The first compensator 206 may generate the first compensation data OD1 based on the first convert data CD1 and the second convert data CD2 using the first average filter. The first average filter may generate the average value of the first convert data CD1 provided to a reference pixel and the first convert data CD1 provided to peripheral pixels that include the reference pixel as the first compensation data OD1 of the reference pixel.

Referring to FIG. 5A, the first average filter may generate the average value of the first convert data CD1 of 32 pixels that include the reference pixel PX_R as the first compensation data OD1 of the reference pixel PX_R. That is, the first average filter may generate the average value of the first convert data CD1 of the 15 pixels arranged in a left direction of the reference pixel PX_R, the first convert data CD1 of the reference pixel PX_R, and the first convert data CD1 of the 16 pixels arranged in a right direction of the reference pixel PX_R as the first compensation data OD1 of the reference pixel PX_R.

Referring to FIG. 5B, the first average filter may generate the average value of the first convert data CD1 of 96 pixels that include the reference pixel PX_R. That is, the first average filter may generate the average value of the first convert data CD1 of the reference pixel PX_R and the first convert data CD1 of the 95 pixels arranged around the reference pixel PX_R as the first compensation data OD1 of the reference pixel PX_R.

The first average filter may calculate the first compensating data CD1 by performing the sampling of the first convert data CD1 of the peripheral pixels of the reference pixel PX_R. In this case, a logic size may decrease.

The first average filter may generate the first compensation data OD1 based on the first convert data CD1 and the second convert data CD2 provided from the first receiver when the one of the pixels in the first display area adjacent to the second display area is the reference pixel. In an exemplary embodiment, the first compensator 206 may generate the first compensation data OD1 of the reference pixel in the first display area adjacent to the second display area based on the first convert data CD1 of the reference pixel in the first display area, the first convert data CD1 of the 15 peripheral pixels adjacent to the reference pixel in the first area, and the second convert data CD2 of the 16 peripheral pixels adjacent to the reference pixel in the second area when the first filter calculate the average value based on the first convert data CD1 of the 32 pixels that include the reference pixel, for example. Here, the second convert data CD2 may be provided from the second converter 252 of the second image processor 250.

Referring to FIG. 4, the second image processor 250 may include the second converter 252, the second receiver 254, and the second compensator 256.

The second converter 252 may convert a second image data ID2 into a second convert data CD2. Here, the second image data ID2 may be a RGB data and the second convert data CD2 may be a HSV data. The second converter 252 may provide the second convert data CD2 to the second receiver 254. Further, the second converter 252 may provide the second convert data CD2 of pixels in the second display area adjacent to the first display area to the first receiver 204 of a first image processor 200.

The second receiver 254 may receive the second convert data CD2 from the second converter 252 and a first convert data CD1 of pixels in the first display area adjacent to the second display area from a first converter 202. In some exemplary embodiments, the second receiver 254 may receive the first convert data CD1 of n/2 pixels in the first display area adjacent to the second display area when the second average filter of the second compensator 256 generates the average value of the second convert data CD2 of n pixels in the second display area as the second compensation data OD2. In other exemplary embodiments, the second image receiver 254 may receive a representation value of the first convert data CD1 of n/2 pixels in the first display area adjacent to the second display area when the second average filter of the second compensator 256 generates the average value of the second convert data CD2 of n pixels in the second display area as the second compensation data OD2. In other exemplary embodiments, the second receiver 254 may receive a sampling value of the first convert data CD1 of n/2 pixels in the first display area adjacent to the second display area when the second average filter of the second compensator 256 generates the average value of the second convert data CD2 of n pixels in the second display area as the second compensation data OD2.

The second receiver 254 may receive the first convert data CD1 to which the sampling is performed and interpolate the first convert data CD1 in order to decrease an exchanging amount of data between the second image processor 250 and the first image processor 200.

The second compensator 256 may generate the second compensation data OD2 based on the second convert data CD2 and the first convert data CD1 using the second average filter. The second average filter may generate the average value of the second convert data CD2 provided to a reference pixel and the second convert data CD2 provided to peripheral pixels that include the reference pixel as the second compensation data OD2 of the reference pixel.

Referring to FIG. 5A, the second average filter may generate the average value of the second convert data CD2 of 32 pixels that include the reference pixel PX_R as the second compensation data OD2 of the reference pixel PX_R. That is, the second average filter may generate the average value of the second convert data CD2 of the 15 pixels arranged in a left direction of the reference pixel PX_R, the second convert data CD2 of the reference pixel PX_R, and the second convert data CD2 of the 16 pixels arranged in a right direction of the reference pixel PX_R as the second compensation data OD2 of the reference pixel PX_R.

Referring to FIG. 5B, the second average filter may generate the average value of the second convert data CD2 of 96 pixels that include the reference pixel PX_R. That is, the second average filter may generate the average value of the second convert data CD2 of the reference pixel PX_R and the second convert data CD2 of the 95 pixels arranged around the reference pixel PX_R as the second compensation data OD2 of the reference pixel PX_R.

The second average filter may calculate the second compensating data CD2 by performing the sampling of the second convert data CD2 of the peripheral pixels of the reference pixel PX_R. In this case, a logic size may decrease.

The second average filter may generate the second compensation data OD2 based on the second convert data CD2 and the first convert data CD1 provided from the second receiver 254 when the one of the pixels in the second display area adjacent to the first display area is the reference pixel. In an exemplary embodiment, the second compensator 256 may generate the second compensation data OD2 of the reference pixel in the second display area adjacent to the first display area based on the second convert data CD2 of the reference pixel in the second display area, the second convert data CD2 of the 15 peripheral pixels adjacent to the reference pixel in the second area, and the first convert data CD1 of the 16 peripheral pixels adjacent to the reference pixel in the first area when the second filter calculate the average value based on the second convert data CD2 of the 32 pixels that include the reference pixel, for example. Here, the first convert data CD1 may be provided from the first converter 202 of the first image processor 200.

As described above, the first image processor 200 and the second image processor 250 may prevent the user from recognizing the boundary of the first display area and the second display area by including the first receiver 204 and the second receiver 254 that receive the first convert data CD1 and the second convert data CD2 and generating the first compensation data CD1 and the second compensation data CD2 based on the first convert data CD1 and the second convert data CD2.

Figure 6:
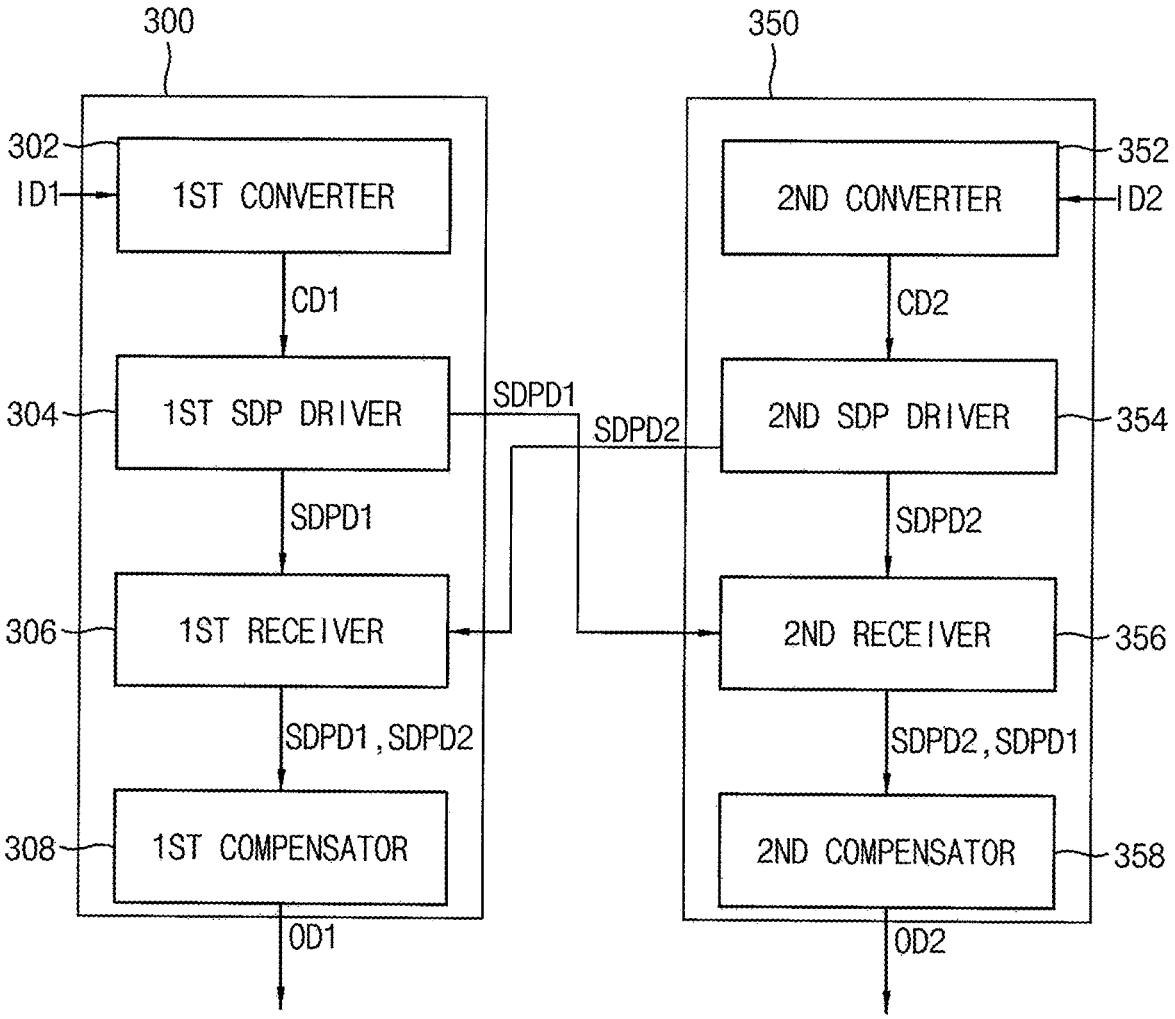
FIG. 6 is a block diagram illustrating another exemplary embodiment of a first image processor and a second image processor included in the display device of FIG. 1.
Figure 7:
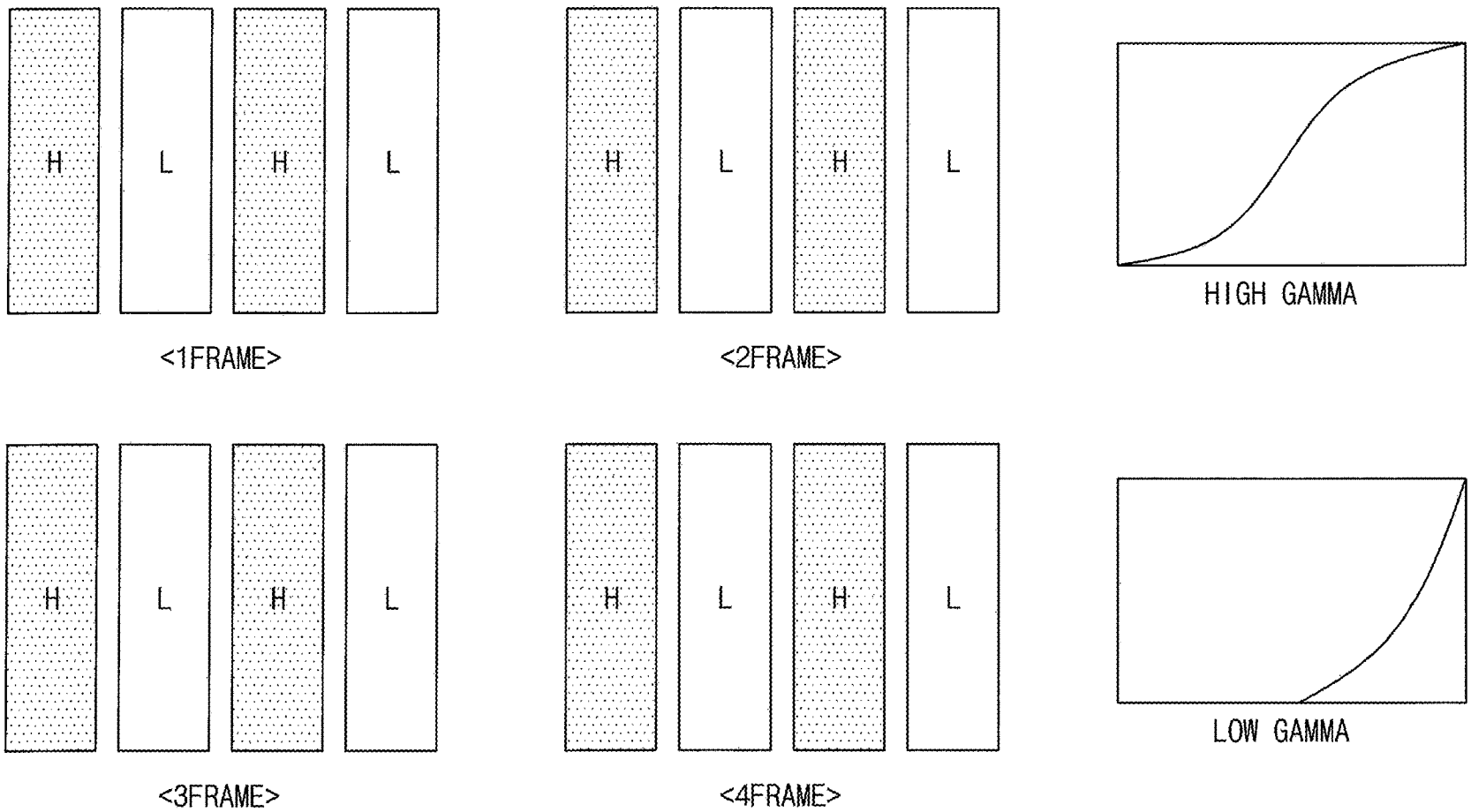
FIG. 7 is a diagram illustrating an exemplary embodiment of an operation of a first spatial dividing panel ("SDP") driver and a second SDP driver included in the first image processor and the second image processor of FIG. 6.

FIG. 6 is a block diagram illustrating other example of a first image processor 142 and a second image processor 162 included in the display device of FIG. 1 and FIG. 7 is a diagram illustrating for describing an operation of a first spatial diving panel driver and a second spatial dividing panel ("SDP") driver included in the first image processor and the second image processor of FIG. 6.

Referring to FIG. 6, a first image processor 300 may include a first converter 302, a first receiver 306, a first SDP driver 304, and a first compensator 308. The first processor of FIG. 6 may be substantially the same with or similar to the first image processor 200 of FIG. 5 except that the first image processor 300 of FIG. 6 includes the first SDP driver 304.

The first SDP driver 304 included in the first image processor 300 of FIG. 6 may detect a compensating area based on the first convert data CD1 and perform the SDP driving method to the compensating area.

Referring to FIG. 7, the dividing panel driving method that adjusts a high gamma to a part of pixels and adjusts a low gamma to other pixels in the same frame is used in order to improve a viewing angle of the display device. The SDP driving method may adjust a predetermined image (e.g., a skin color) displayed on the display panel because the display quality is degraded when the SDP driving method adjusts the whole image. Although the SDP driving method that adjust another gamma to each of the pixels is described in FIG. 7, the SDP driving method is not limited thereto. In an exemplary embodiment, the SDP driving method may provide the high gamma to a part of sub-pixels and provide the low gamma to other part of the sub-pixels in the same frame, for example.

The first SDP driver 304 may detect the compensating area in the first display area based on the first convert data CD1 provided from the first converter 302. In an exemplary embodiment, the first SDP driver 304 may detect an area of which the first convert data CD1 satisfies a predetermined condition about a hue, a saturation, and a value as the compensating area, and adjust the SDP driving method to the compensating area, for example.

The first receiver 306 may receive first SDP data SDPD1 from the first SDP driver 304, and second SDP data SDPD2 from a second SDP driver 354 of the second image processor 350. Here, the first receiver 306 may be operated as the same with the first receiver 204 of the first image processor 200 of FIG. 4.

The second SDP driver 354 may detect the compensating area in the second display area based on the second convert data CD2 provided from the second converter 352. In an exemplary embodiment, the second SDP driver 354 may detect an area of which the second convert data CD2 satisfies a predetermined condition about a hue, a saturation, and a value as the compensating area, and adjust the SDP driving method to the compensating area, for example.

The second receiver 356 may receive the second SDP data SDPD2 from the second SDP driver 354, and first SDP data SDPD1 from the first SDP driver 304 of the first image processor 300. Here, the second receiver 356 may be operated as the same with the second receiver 254 of the second image processor 250 of FIG. 4. The second compensator 358 outputs the second compensation data OD2 based on the second SDP data SDPD2 and the first SDP data SDPD1.

Figure 8:
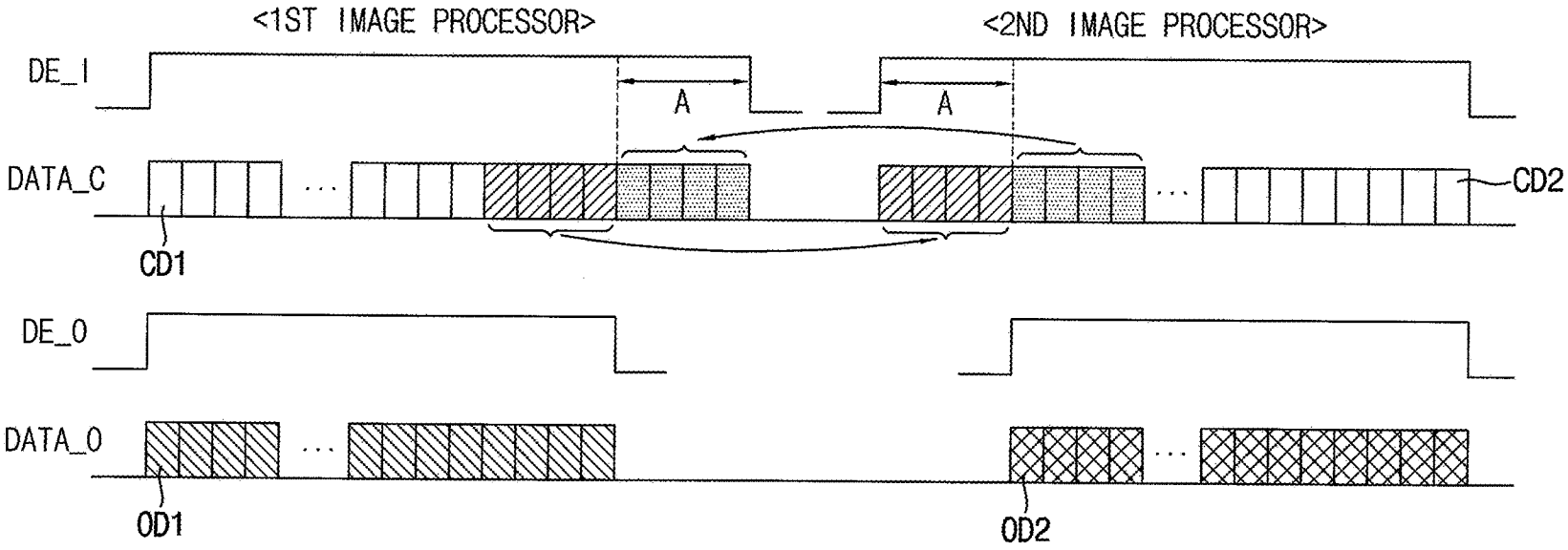
FIG. 8 is a diagram illustrating an exemplary embodiment of an operation of a first image processor and a second image processor included in the display device.

FIG. 8 is a diagram illustrating for describing an operation of a first image processor and a second image processor included in the display device.

Referring to FIG. 8, the first image processor and the second image processor may increase a length of an input data enable signal DE_I.

The first image processor may receive the second convert data CD2 provided from the second image processor during a A period in which the length of the data enable signal DE_I increases. The first image processor may receive the second convert data CD2 of n/2 pixels in the second display area adjacent to the first display area when the first average filter of the first image processor generates the average value of the first convert data CD1 of n pixels as the first compensation data OD1. In an exemplary embodiment, the first image processor may receive the second convert data CD2 of 4 pixels in the second display area adjacent to the first area when the first average filter of the first image processor generates the average value of 8 pixels as the first compensation data OD1, for example. The first image processor may generate the first compensation data OD1 based on the first convert data CD1 and the second convert data CD2. The first compensation data OD1 may be output synchronized with an output data enable signal DE_O.

The second image processor may receive the first convert data CD1 provided from the first image processor during a B period in which the length of the data enable signal DE_I increases. The second image processor may receive the first convert data CD1 of n/2 pixels in the first display area adjacent to the second display area when the second average filter of the second image processor generates the average value of the second convert data CD2 of n pixels as the second compensation data OD2. In an exemplary embodiment, the second image processor may receive the first convert data CD1 of 4 pixels in the first display area adjacent to the second area when the second average filter of the second image processor generates the average value of 8 pixels as the second compensation data OD2, for example. The second image processor may generate the second compensation data OD2 based on the second convert data CD2 and the first convert data CD1. The second compensation data OD2 may be output synchronized with an output data enable signal DE_O.

Figure 9:
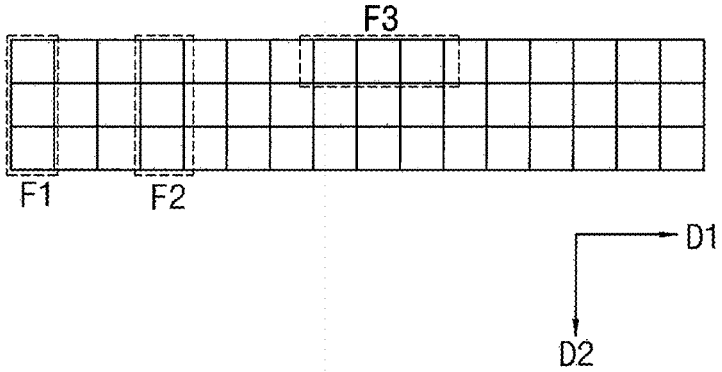
FIG. 9 is a diagram illustrating an exemplary embodiment of an operation of a first receiver and a second receiver included in the first image processor and the second image processor of FIG. 4.

FIG. 9 is a diagram illustrating for describing an operation of a first receiver and a second receiver included in the first image processor and the second image processor of FIG. 4.

Referring to FIG. 9, the first receiver and the second receiver may receive a representation value of the first convert data and the second convert data. In an exemplary embodiment, the first receiver may receive the representation value that includes the second convert data F1 of the pixels arranged in a second direction D2 and the second receiver may receive the representation value that includes the first convert data of the pixels arranged in the second direction D2, for example. Further, the first receiver may receive the representation value that includes the second convert data F2 of the pixels arranged in a first direction D1 and the second direction D2 and the second receiver may receive the representation value that includes the first convert data of the pixels arranged in the first direction D1 and the second direction D2. Further, the first receiver may receive the representation value that includes the second convert data F3 of the pixels arranged in the first direction D1 and the second receiver may receive the representation value that includes the first convert data of the pixels arranged in the first direction D1.

As described above, the first receiver and the second receiver may decrease an exchanging amount of the data between the first image processor and the second image processor by receiving the representation value of the first convert data and the second convert data.

Figure 10A:
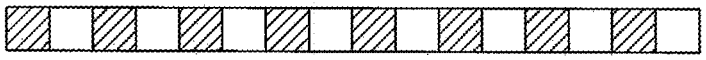
FIGS. 10A and 10B are diagrams illustrating an exemplary embodiment of an operation of a first compensator and a second compensator included in the first image processor and the second image processor of FIG. 5.
Figure 10B:
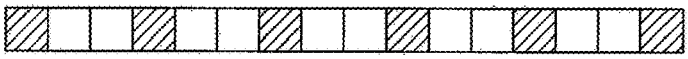
Figure 10C:
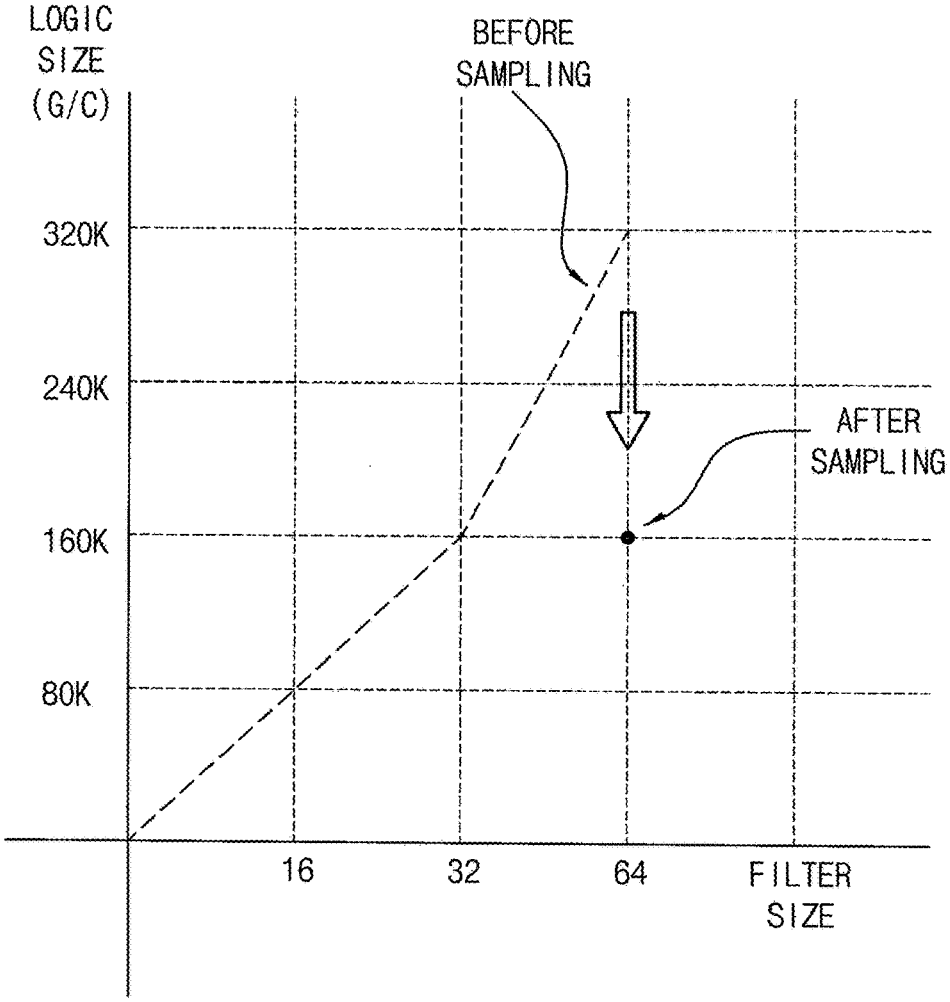
FIG. 10C is a graph illustrating an exemplary embodiment of an effect of the first compensator and the second compensator of FIGS. 10A and 10B.

FIGS. 10A and 10B are diagrams illustrating for describing an operation of a first compensator and a second compensator included in the first image processor and the second image processor of FIG. 5, and FIG. 10C is a graph illustrating for describing an effect of the first compensator and the second compensator of FIGS. 10A and 10B Referring to FIGS. 10A and 10B, the first compensator of the first image processor may generate the first compensation data by performing the sampling of the first convert data and the second compensator of the second image processor may generate the second compensation data by performing the sampling of the second convert data. Further, the first receiver of the first image processor may receive the sampling value of the second convert data of the pixels in the second display area adjacent to the first display area and the second receiver of the second image processor may receive the sampling value of the first convert data of the pixels in the first display area adjacent to the second display area.

As described in FIG. 10A, the first average filter of the first compensator may select the first convert data of 8 pixels among 16 pixels, and generate the average value of the first convert data of the 8 pixels as the first compensation data. The second average filter of the second compensator may select the second convert data of 8 pixels among 16 pixels, and generate the average value of the second convert data of the 8 pixels as the second compensation data. Further, the first receiver may select the second convert data of 4 pixels among 8 pixels adjacent to the first display area and receive the second convert data of the 4 pixels. The second receiver may select the first convert data of 4 pixels among 8 pixels adjacent to the second display area and receive the first convert data of the 4 pixels.

As described in FIG. 10B, the first average filter of the first compensator may select the first convert data of 6 pixels among 16 pixels, and generate the average value of the first convert data of the 6 pixels as the first compensation data. The second average filter of the second compensator may select the second convert data of 6 pixels among 16 pixels, and generate the average value of the second convert data of the 6 pixels as the second compensation data. Further, the first receiver may select the second convert data of 3 pixels among 8 pixels adjacent to the first display area and receive the second convert data of the 3 pixels. The second receiver may select the first convert data of 3 pixels among 8 pixels adjacent to the second display area and receive the first convert data of the 3 pixels.

As described in FIG. 10C, the first image processor and the second image processor may decrease a size of the logic by sampling and compensating the first convert data and the second convert data. Further, the exchanging amount of the data between the first image processor and the second image processor may decrease by sampling and exchanging the first convert data and the second convert data.

Figure 11:
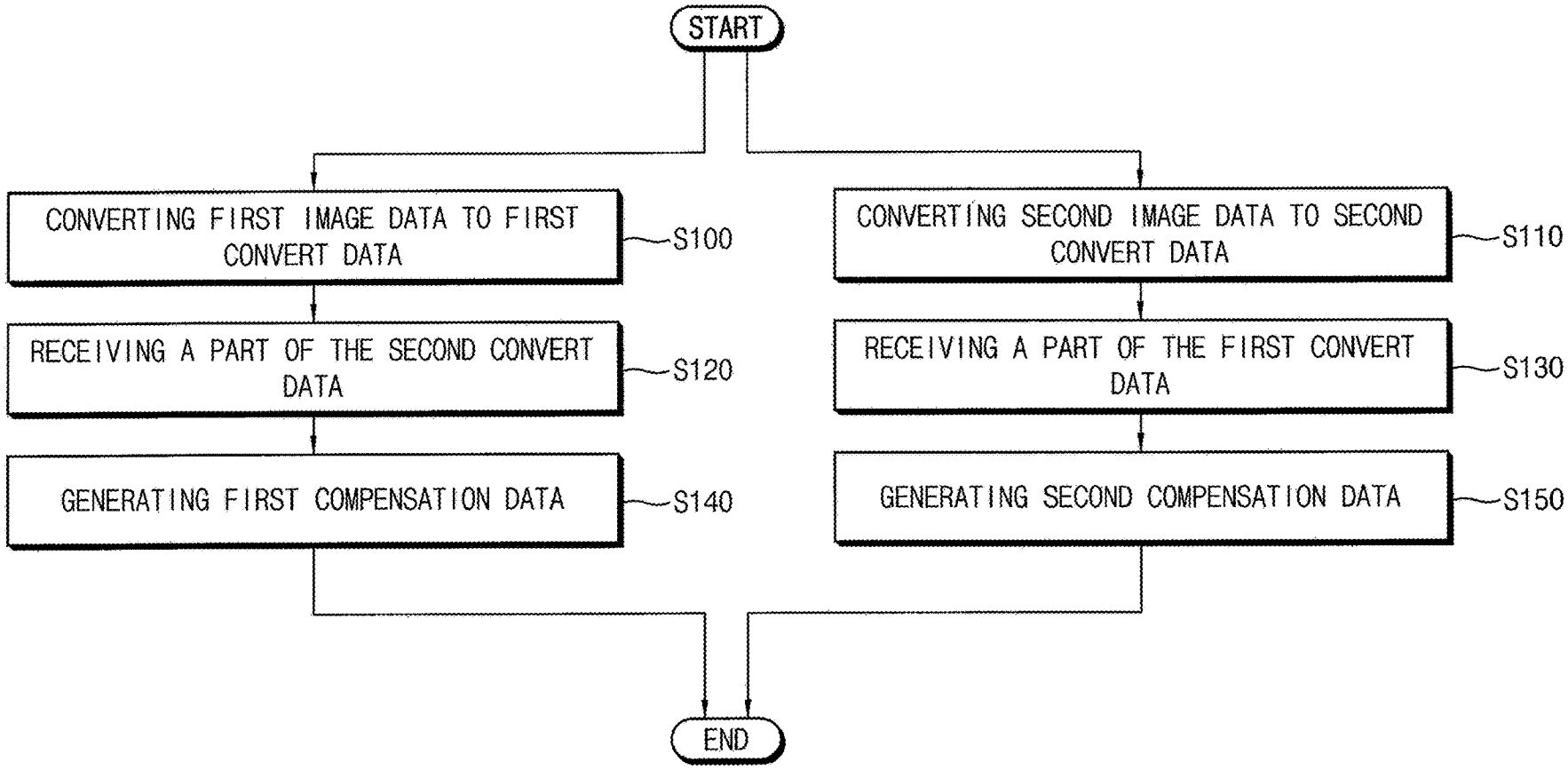
FIG. 11 is a flowchart illustrating an exemplary embodiment of a driving method of a display device.

FIG. 11 is a flowchart illustrating a driving method of a display device according to exemplary embodiments.

Referring to FIG. 11, a driving method of a display device may include an operation S100 of converting a first image data to a first convert data in a first image processor, an operation S110 of converting a second image data to a second convert data in a second image processor, an operation S120 of receiving a part of the second convert data in the first image processor, an operation S130 of receiving a part of the first convert data in the second image processor S130, an operation S140 of generating a first compensation data based on the first convert data and the part of the second convert data in the first image processor, and an operation S150 of generating a second compensation data based on the second convert data and the part of the first convert data in the second image processor.

In the operation S100, the driving method of the display device may convert the first image data to the first convert data in the first image processor. The first image processor may receive the first image data and convert the first image data to the first convert data. Here, the first image data may be RGB data that includes red data, green data and blue data. The first convert data may be HSV data that includes a hue, a saturation, and a value.

In the operation S110, the driving method of the display device may convert the second image data to the second convert data in the second image processor. The second image processor may receive the second image data and convert the second image data to the second convert data. Here, the second image data may be RGB data that includes red data, green data, and blue data. The second convert data may be HSV data that includes a hue, a saturation, and a value.

In the operation of S120, the driving method of the display device may receive the part of the second convert data in the first image processor. The first image processor may receive the second convert data of pixels in a second display area adjacent to a first display area. In some exemplary embodiments, the first image processor may receive the second convert data of n/2 pixels in the second display area adjacent to the first display area when a first average filter of the first image processor generates an average value of the first convert data of n pixel as a first compensation data. In other exemplary embodiments, the first image processor may receive a representation value of the second convert data of n/2 pixels in the second display area adjacent to the first display area when the first average filter of the first image processor generates an average value of the first convert data of n pixel as a first compensation data. In other exemplary embodiments, the first image processor may receive a sampling value of the second convert data of n/2 pixels in the second display area adjacent to the first display area when the first average filter of the first image processor generates an average value of the first convert data of n pixel as a first compensation data.

In the operation S130, the driving method of the display device may receive the part of the first convert data in the second image processor. The second image processor may receive the first convert data of pixels in the first display area adjacent to the second display area. In some exemplary embodiments, the second image processor may receive the first convert data of n/2 pixels in the first display area adjacent to the second display area when a second average filter of the second image processor generates an average value of the second convert data of n pixel as a second compensation data. In other exemplary embodiments, the second image processor may receive a representation value of the first convert data of n/2 pixels in the first display area adjacent to the second display area when the second average filter of the second image processor generates an average value of the second convert data of n pixel as a second compensation data. In other exemplary embodiments, the second image processor may receive a sampling value of the first convert data of n/2 pixels in the first display area adjacent to the second display area when the second average filter of the second image processor generates an average value of the second convert data of n pixel as a second compensation data.

In operation S140, the driving method of the display device may generate the first compensation data based on the first convert data and the part of the second convert data in the first image processor. The first image processor may generate the first compensation data of the pixels in the first display area adjacent to the second display area based on the first convert data and the part of the second convert data. In an exemplary embodiment, the first image processor may generate the first compensation data of a reference pixel arranged in an outermost of the first display area adjacent to the second display area based on the first convert data of the reference pixel in the first display area, the first convert data of the (n/2−1) pixels adjacent to the reference pixel in the first display area, and the second convert data of the (n/2) pixels adjacent to the reference pixel in the second display area when the first image processor generates the average value of the convert data of n pixels as the first compensation data, for example.

In operation S150, the driving method of the display device may generate the second compensation data based on the second convert data and the part of the first convert data in the second image processor. The second image processor may generate the second compensation data of the pixels in the second display area adjacent to the first display area based on the second convert data and the part of the first convert data. In an exemplary embodiment, the second image processor may generate the second compensation data of a reference pixel arranged in an outermost of the second display area adjacent to the first display area based on the second convert data of the reference pixel in the second display area, the second convert data of the (n/2−1) pixels adjacent to the reference pixel in the second display area, and the first convert data of the (n/2) pixels adjacent to the reference pixel in the first display area when the second image processor generates the average value of the convert data of n pixels as the second compensation data, for example.

As described above, the driving method of the display device according to exemplary embodiments may prevent the user to recognize a boundary of the first display area and the second display area by exchanging the first and the second convert data provided to the pixels disposed in the boundary of the first display area and the second display area and generating the first compensation data and the second compensation data.

Figure 12:
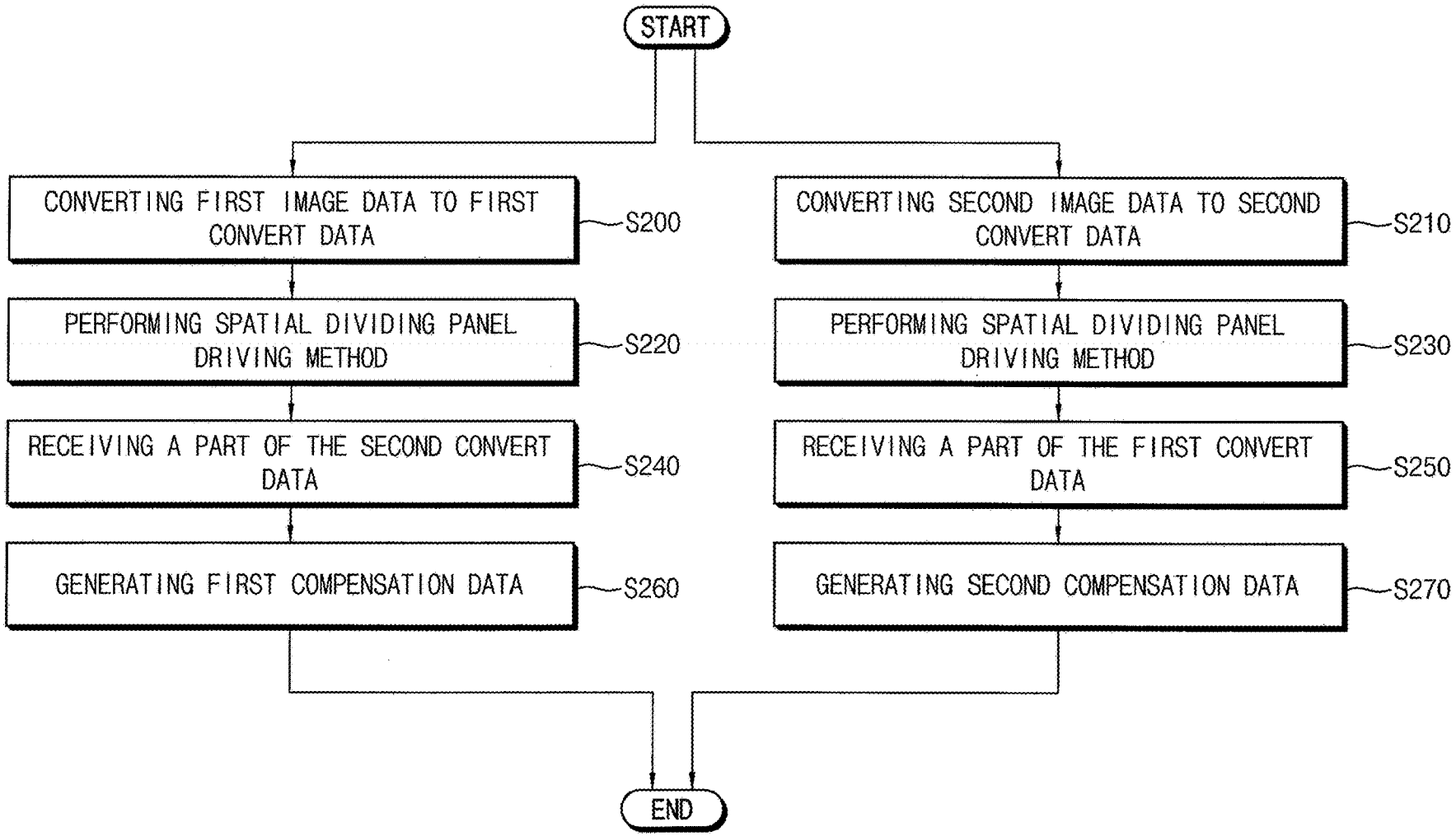
FIG. 12 is a flowchart illustrating another exemplary embodiment of the driving method of a display device of FIG. 11.

FIG. 12 is a flowchart illustrating other example of the driving method of a display device of FIG. 11.

Referring to FIG. 12, a driving method of a display device may include an operation S200 of converting a first image data to a first convert data in a first image processor, an operation S210 of converting a second image data to a second convert data in a second image processor, an operation S220 of performing an SDP driving method based on the first convert data, an operation S230 of performing the SDP driving method based on the second convert data, an operation S240 of receiving a part of the second convert data in the first image processor, an operation S250 of receiving a part of the first convert data in the second image processor, an operation S260 of generating a first compensation data based on the first convert data and the part of the second convert data in the first image processor, and an operation S270 of generating a second compensation data based on the second convert data and the part of the first convert data in the second image processor. The driving method of the display device of FIG. 12 may be substantially the same with or similar to the driving method of the display device of FIG. 11 except that the driving method of the display device of FIG. 12 further includes the operation S220 of performing the SDP driving method based on the first convert data and the operation S230 of performing the SDP driving method based on the second convert data.

The SDP driving method that provides high gamma to a part of the pixels and low gamma to another part of the pixels in the same frame may be used to improve a viewing angle of the display device.

In the operation S220, the driving method of the display device may perform the SDP driving method based on the first convert data. The driving method of the display device may detect a compensating area based on the first convert data. In an exemplary embodiment, an area of which the first convert data satisfies a predetermined condition about a hue, a saturation, and a value may be detected as the compensating area, for example.

In the operation S230, the driving method of the display device may perform the SDP driving method based on the second convert data. The driving method of the display device may detect a compensating area based on the second convert data. In an exemplary embodiment, an area of which the second convert data satisfies a predetermined condition about a hue, a saturation, and a value may be detected as the compensating area, for example.

The invention may be applied to a display device and an electronic device having the display device. In an exemplary embodiment, the invention may be applied to a computer monitor, a laptop, a digital camera, a cellular phone, a smart phone, a smart pad, a television, a personal digital assistant ("PDA"), a portable multimedia player ("PMP"), a MP3 player, a navigation system, a game console, a video phone, etc., for example.

The foregoing is illustrative of exemplary embodiments and is not to be construed as limiting thereof. Although a few exemplary embodiments have been described, those skilled in the art will readily appreciate that many modifications are possible in the exemplary embodiments without materially departing from the novel teachings and advantages of the invention. Accordingly, all such modifications are intended to be included within the scope of the invention as defined in the claims. Therefore, it is to be understood that the foregoing is illustrative of various exemplary embodiments and is not to be construed as limited to the specific exemplary embodiments disclosed, and that modifications to the disclosed exemplary embodiments, as well as other exemplary embodiments, are intended to be included within the scope of the appended claims.

What is claimed is:

1. A display device comprising:

a display panel including a plurality of pixels, a first display area and a second display area;

a first image processor which receives a first image data to be provided to the first display area, converts the first image data to a first convert data, and generates a first compensation data provided to the first display area using a first average filter; and a second image processor which receives a second image data to be provided to the second display area, converts the second image data to a second convert data, and generates a second compensation data provided to the second display area using a second average filter, wherein the first image processor receives the second convert data of pixels of the plurality of pixels in the second display area adjacent to the first display area from the second image processor, and calculate the first compensation data based on the first convert data and the second convert data; and wherein the second image processor receives the first convert data of pixels of the plurality of pixels in the first display area adjacent to the second display area from the first image processor, and calculate the second compensation data based on the second convert data and the first convert data.

2. The display device of claim 1, wherein the first convert data and the second convert data are HSV data.

3. The display device of claim 1, wherein the first image processor includes:

a first converter which converts the first image data to the first convert data;

a first receiver which receives the first convert data from the first converter, and receives the second convert data of the pixels in the second display area adjacent to the first display area from the second image processor; and a first compensator which generates the first compensation data based on the first convert data and the second convert data using the first average filter.

4. The display device of claim 3, wherein the first image processor further includes:

a spatial dividing panel driver which detects a compensating area based on the first convert data, and performs a spatial dividing panel driving method to the compensating area.

5. The display device of claim 3, wherein the first receiver receives the second convert data of n/2 pixels of the pixels in the second display area adjacent to the first display area when the first average filter generates the first compensation data by calculating an average value of the first convert data of n pixels of the pixels in the first display area.

6. The display device of claim 3, wherein the first receiver receives a representation value of the second convert data of the pixels in the second display area adjacent to the first display area.

7. The display device of claim 3, wherein the first receiver receives a sampling value of the second convert data of the pixels in the second display area adjacent to the first display area.

8. The display device of claim 1, wherein the second image processor includes:

a second converter which converts the second image data to the second convert data;

a second receiver which receives the second convert data from the second converter, and receives the first convert data of the pixels in the first display area adjacent to the second display area from the first image processor; and a second compensator which generates the second compensation data based on the first convert data and the second convert data using the second average filter.

9. The display device of claim 8, wherein the second image processor further includes:

a spatial dividing panel driver which detects a compensating area based on the second convert data, and performs a spatial dividing panel driving method to the compensating area.

10. The display device of claim 8, wherein the second receiver receives the first convert data of n/2 pixels of the pixels in the first display area adjacent to the second display area when the second average filter generates the second compensation data by calculating an average value of the second convert data of n pixels of the pixels in the second display area.

11. The display device of claim 8, wherein the second receiver receives a representation value of the first convert data of the pixels in the first display area adjacent to the second display area.

12. The display device of claim 8, wherein the second receiver receives a sampling value of the first convert data of the pixels in the first display area adjacent to the second display area.

13. The display device of claim 1, wherein the first average filter generates the first compensation data by sampling the first convert data and the second convert data, and wherein the second average filter generates the second compensation data by sampling the first convert data and the second convert data.

14. A driving method of a display device, the driving method comprising:

converting a first image data to a first convert data in a first image processor;

converting a second image data to a second convert data in a second image processor;

receiving a part of the second convert data in the first image processor;

receiving a part of the first convert data in the second image processor;

generating a first compensation data based on the first convert data and the part of the second convert data in the first image processor; and generating a second compensation data based on the second convert data and the part of the first convert data in the second image processor.

15. The driving method of claim 14, further comprising:

detecting a first compensating area of a first display area based on the first convert data and performing a spatial dividing panel driving method to the first compensating area; and detecting a second compensating area of a second display area based on the second convert data and performing the spatial dividing panel driving method to the second compensating area.

16. The driving method of claim 14, wherein the first convert data and the second convert data are HSV data.

17. The driving method of claim 14, wherein the first image processor receives a representation value of the second convert data, and wherein the second image processor receives a representation value of the first convert data.

18. The driving method of claim 14, wherein the first image processor generates the first compensation data by sampling the first convert data and the part of the second convert data, and wherein the second image processor generates the second compensation data by sampling the second convert data and the part of the first convert data.

19. The driving method of claim 14, wherein the first image processor receives a sampling value of the part of the second convert data, and wherein the second image processor receives a sampling value of the part of the first convert data.

20. The driving method of claim 14, wherein the first image processor receives a representation value of the second convert data, and wherein the second image processor receives a representation value of the first convert data.

* * * * *